United States Patent [19]

Matsuda

[11] Patent Number: 5,067,969

[45] Date of Patent: Nov. 26, 1991

[54] CUTTER AND MANUFACTURING METHOD THEREFOR

[75] Inventor: Yusaku Matsuda, Yamatokoriyama, Japan

[73] Assignee: Sanwa Diamond Industrial Co., Ltd., Japan

[21] Appl. No.: 491,341

[22] Filed: Mar. 9, 1990

[51] Int. Cl.[5] ..... B24D 3/00

[52] U.S. Cl. ..... 51/293; 51/298; 51/309

[58] Field of Search ..... 51/293, 298, 309

[56] References Cited

U.S. PATENT DOCUMENTS

| | | | |
|---|---|---|---|
| 4,341,532 | 7/1982 | Oide | 51/293 |
| 4,690,691 | 9/1987 | Komanduri | 51/293 |
| 4,817,341 | 4/1989 | Unieda | 51/293 |
| 4,929,256 | 5/1990 | Shepherd | 51/293 |

*Primary Examiner*—William R. Dixon, Jr.
*Assistant Examiner*—Willie Thompson
*Attorney, Agent, or Firm*—Ostrolenk, Faber, Gerb & Soffen

[57] ABSTRACT

A cutter comprises a base plate formed by joining two thin annular members with each other; a groove formed in the outer periphery of the base plate; an annular metal supporting plate, to be positioned in the groove of the base plate, having a plurality of openings formed therethrough; and a cutting member formed around the outer periphery of the base plate with the supporting plate thereby. In the above construction, the cutting member is formed by sintering a mixture of abrasive grains and powders formed by alloying copper, cobalt and tin with each other.

Since the base plate is formed by adhereing the two annular members to each other, the strength of the base plate is higher than those of conventional cutters. Therefore, there is little possibility that the base is damaged while the cutter is being used.

In addition, since the supporting plate is sandwiched between the two annular members, and the cutting member is bonded, in a high strength, with the supporting plate having openings formed therethrough.

9 Claims, 2 Drawing Sheets

CUTTER AND MANUFACTURING METHOD THEREFOR

BACKGROUND OF THE INVENTION

1. Field of the Invention

The present invention relates to a cutter and a manufacturing method therefor and, more particularly, to a cutter to be used to cut a stone and a manufacturing method therefor.

2. Description of the Prior Art

FIG. 4 is a perspective view showing a known cutter which forms a background of the present invention. The cutter 1 includes an annular base plate 2 made of, for example, stainless steel. Concave and convex portions are formed on the periphery of the base plate 2. A cutting member 4 is formed on the convex portions 3 of the base plate 2. The cutting member 4 is formed by sintering a mixture of abrasive grains such as fine diamond powders and metal powders. When the cutter 1 cuts a workpiece, for example, a stone, the cutting member 4 thereof rotates in contact with the stone.

However, the strength of the cutter described above is not high, so that the base plate is likely to break while the cutter is being used. This is because the base plate thereof is made of a single thin plate.

In addition, the cutter has the following disadvantage. That is, the cutting member is not joined with the base plate in a high strength because the cutting member is formed by sintering the material of the cutting member onto the outer periphery of the base plate. Therefore, when the cutter is used, there is much possibility that the base plate and the cutting member are separated from each other or the cutting member breaks.

SUMMARY OF THE INVENTION

It is, therefore, an essential object of the present invention to provide a cutter in which the strength of the base plate is high and the base plate and the cutting member are joined with each other in a high strength.

It is a further object of the present invention to provide a manufacturing method therefor.

According to the first invention, a cutter comprises a base plate formed by joining two thin annular members with each other; a groove formed in the outer periphery of the base plate; an annular metal supporting plate, to be positioned in the groove of the base plate, having a plurality of openings formed therethrough; and a cutting member formed around the outer periphery of the base plate with the supporting plate thereby. In the above construction, the cutting member is formed by sintering a mixture of abrasive grains and powders formed by alloying copper, cobalt and tin with each other.

According to the second invention, a method for manufacturing a cutter comprises the steps of: preparing thin first and second annular members having a recess formed on the outer periphery thereof, respectively; preparing an annular metal supporting plate, to be positioned in the recess of the first annular member, having a plurality of openings formed therethrough; preparing abrasive grains and powders formed by alloying copper, cobalt, tin with each other; forming an annular powder-compressed member by applying pressure to the powder; positioning the supporting plate in the recess of the first annular member; joining the second annular member with the first annular member by sandwiching the supporting plate therebetween; positioning the powder-compressed member around the outer peripheries of the first and second annular members with the supporting plate surrounded thereby; and sintering the powder-compressed member with pressure applied thereto from both sides thereof.

The base plate is formed by joining the two annular members with each other with an adhesive, and the supporting member is firmly supported by the groove formed in the peripheries of the two annular members constituting the base plate.

Further, sintered powders penetrate into the openings of the supporting plate and are fused onto the surface of the supporting plate. Thus, the cutting member is firmly bonded with supporting plate.

According to the present invention, since the base plate is formed by adhering the two annular members to each other, the strength of the base plate is higher than those of conventional cutters. Therefore, there is little possibility that the base is damaged while the cutter is being used.

In addition, since the supporting plate is sandwiched between the two annular members, and the cutting member is bonded, in a high strength, with the supporting plate having openings formed therethrough and as such, the base plate and the cutting member are joined with each other in a high bonding strength. This construction reduces the likelihood of the separation of the cutting member from the base plate and the damage or crack of the cutting member.

These objects and other objects, features, aspects and advantages of the present invention will become more apparent from the following detailed description of the embodiment of the present invention when taken in connection with the accompanying drawings.

DESCRIPTION OF THE PREFERRED EMBODIMENTS

Figure 4:
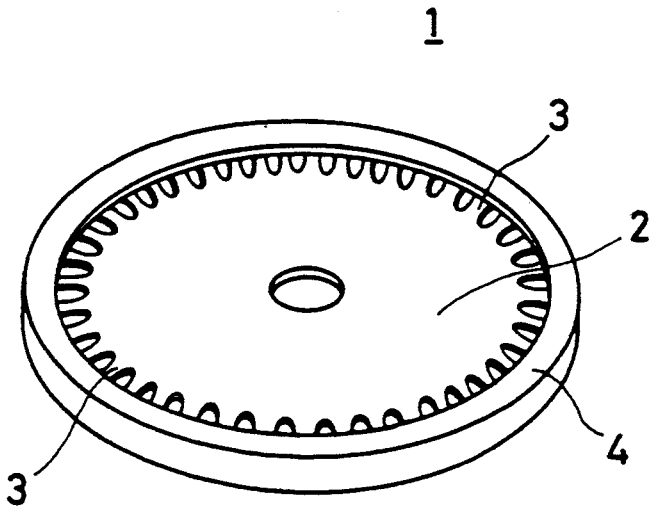
FIG. 4 Prior Art
FIG. 4 is a perspective view showing a known cutter which forms a background of the present invention.
Figure 1:
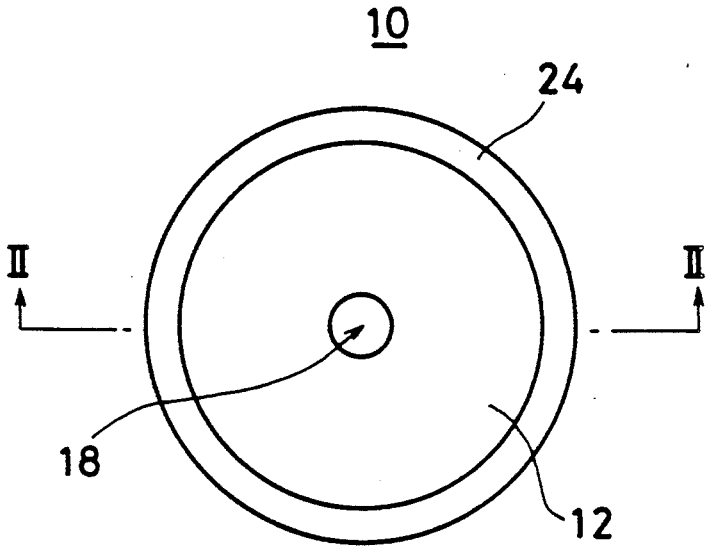
FIG. 1 is a plan view showing a cutter according to an embodiment of the present invention.
Figure 2:
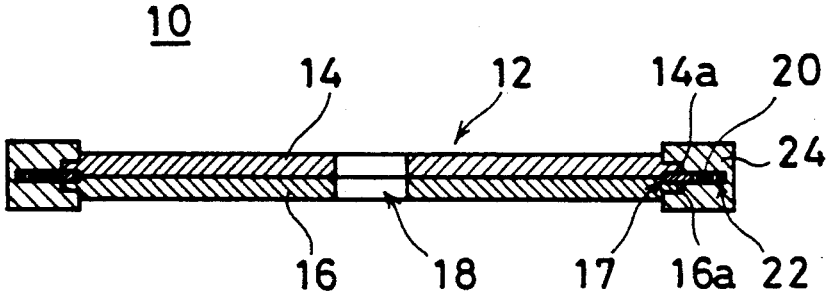
FIG. 2 is a vertical sectional view taken along the lines II—II of FIG. 1.

FIG. 1 is a plan view showing a cutter of an embodiment of the present invention; FIG. 2 is a vertical sectional view taken along the lines II—II of FIG. 1. A cutter 10 includes a base plate 12. The base plate 12 is formed by joining a first annular member 14 and a second annular member 16 with each other with an adhesive. Stainless steel is used to form the thin first and second annular members 14 and 16 so that both members 14 and 16 are identical to each other in the diameters and thicknesses thereof. An opening 18 is formed through the centers of both the first and second annular members 14 and 16 so that a shaft for holding the cutter 10 is inserted therethrough. As best shown in FIG. 2, the outer periphery of the first annular member 14 is thinly formed to form a recess 14*a* below the thin portion of the first annular member 14. Similarly, the second annular member 16 has a recess 16*a* above the thin portion thereof. Thus, the recesses 14*a* and 16*a* form a groove when the first and second annular members 14 and 16 are bonded with each other, which will be described later.

Figure 3:
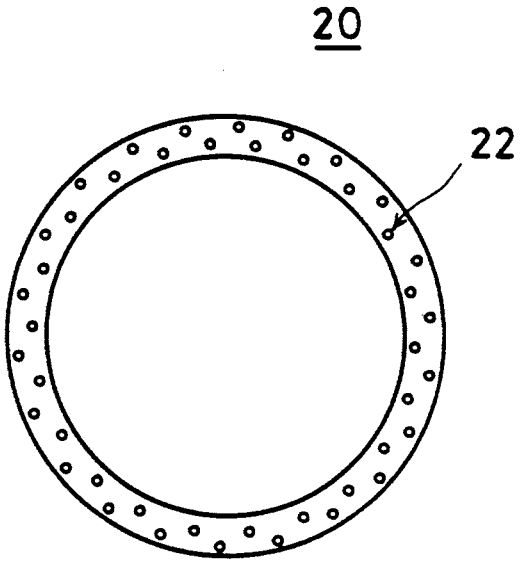
FIG. 3 is a plan view showing a supporting plate for use in the cutter shown in FIG. 1.

An annular supporting plate 20 made of stainless steel as shown in FIG. 3 is positioned in the groove 17 of the base plate 12. The supporting plate 20 may be made of copper or a copper alloy such as brass or phosphor bronze. As described later, since the first and second annular members 14 and 16 are joined with each other with inner peripheral portion of the supporting member 20 sandwiched therebetween, the supporting member 20 is firmly supported by the base plate 12. As shown in FIG. 3, the supporting plate 20 has a plurality of small openings 22, the diameter of which are less than 1 mm. The openings 22 are formed, for example, by punching or etching an annular plate. The supporting plate 20 serves as a means for supporting a cutting member 24 which will be described later.

The cutting member 24 is formed around the outer periphery of the base plate 12. The cutting member 24 is made of a mixture of abrasive grains such as fine diamond abrasives and powders formed by alloying copper (or copper alloy), cobalt, and tin with each other. These metals are mixed with the fine diamond abrasives by powdering them respectively or powdering the alloy thereof. Metal powders such as iron powder or nickel powder may be added to the above-described metal powders in conformity with the material, or the metal of the supporting plate 20. The above-described metal powders are sintered with the supporting plate 20 surrounded thereby so as to form the cutting member 24.

The method for manufacturing the cutter 10 is described below. First, the thin first and second annular members 14 and 16 are prepared. As described previously, the recesses 14*a* and 16*a* are formed on the outer peripheries of the first and second annular members 14 and 16. Next, the supporting plate 20 to be positioned in the recess 14*a* of the first annular member 14 is prepared. It is necessary to take the sizes of the annular supporting plate 20, namely, the inner diameter and thickness thereof into consideration so that it can match the recess 14*a* of the first annular member 14. As described previously, the supporting plate 20 has a plurality of openings 22 formed therethrough.

Thereafter, powders of which the cutting member 24 are made are prepared. As described previously, the powders consist of a mixture of abrasive grains such as fine diamond abrasives and powders formed by alloying copper (or copper alloy), cobalt, and tin with each other. Powdered iron or nickel may be added to the powders as necessary. The powders are compressed by means of a mold as a procedure to form the annular cutting member 24. As shown in FIG. 2, the inner diameter of a powder-compressed material is a little smaller than that of the supporting plate 20 and the outer diameter thereof is a little larger than that of the supporting plate 20.

Next, the supporting plate 20 is positioned in the recess 14*a* of the first annular member 14. Then, the second annular member 16 is bonded with the first annular member 14 with, for example, an adhesive by sandwiching the supporting plate 20 therebetween. Thereafter, the powder-compressed material is positioned around the outer periphery of the first and second annular members 14 and 16 with the supporting plate 20 surrounded thereby.

Then, the powder-compressed material, the base plate 12, and the supporting plate 20 placed in a sintering mold by holding them together as a unit are heated by a high frequency furnace. While they are being heated, pressure is applied to them by a press. Thus, powders are sintered. As a result, part of sintered powders penetrate into the openings 22 of the supporting plate 20 and at the same time, is fused onto the surface thereof. Thus, the cutting member 24 consisting of the powder-compressed material is firmly bonded with the supporting plate 20. Since the supporting plate 20 is unseparably sandwiched between the upper and lower surfaces of the groove 17 of the base plate 12, the supporting plate 20 and the base plate 12 are firmly bonded with each other. Accordingly, the base plate 12 and the cutting member 24 are joined with each other in a great strength through the supporting plate 20.

As apparent from the foregoing, the base plate 12 and the cutting member 24 are not separated from each other during the use of the cutter 10 because the bonding strength therebetween is high. Further, there is little possibility that the cutting member 24 is damaged while the cutter 10 is being used. Furthermore, the base plate 12 is stronger than those of known cutters because it is firmly supported by the first and second annular members 14 and 16 bonded with each other. Therefore, there is likelihood that the cutter 10 is damaged.

Cubic boron nitride may be used instead of the fine diamond powders serving as the abrasive grain to be contained in the material of the cutting member 24.

Although the present invention has been described and illustrated in detail, it is clearly understood that the same is by way of illustration and example only and is not to taken by way of limitation, the spirit and scope of the present invention being limited only by the terms of the appended claims.

What is claimed is:

1. A cutter comprising:

a base plate formed by joining two thin annular members with each other;

a groove formed in the outer periphery of said base plate; and an annular metal supporting plate, to be positioned in said groove of said base plate, having a plurality of openings formed therethrough;

a cutting member formed around the outer periphery of said base plate with said supporting plate surrounded thereby;

wherein said cutting member is formed by sintering a mixture of abrasive grains and powders formed by alloying copper, cobalt and tin with each other.

2. A cutter in accordance with claim 1, wherein a recess is formed on the outer periphery of each of said thin annular members and said groove is formed by said recesses.

3. A cutter in accordance with claim 1, wherein said two thin annular members are joined with each other with an adhesive.

4. A cutter in accordance with claim 1, wherein fine diamond abrasives are used as said abrasive grain.

5. A cutter in accordance with claim 1, wherein cubic boron nitride is used as said abrasive grain.

6. A method for manufacturing a cutter comprising the steps of:

preparing thin first and second annular members having a recess formed on the outer periphery thereof, respectively;

preparing an annular metal supporting plate, to be positioned in said recess of said first annular member, having a plurality of openings formed therethrough;

preparing abrasive grains and powders formed by alloying copper, cobalt, tin with each other;

forming an annular powder-compressed member by applying pressure to said powder;

positioning said supporting plate in said recess of said first annular member;

joining said second annular member with said first annular member with said supporting plate sandwiched therebetween;

positioning said powder-compressed member around the outer peripheries of said first and second annular members with said supporting plate surrounded thereby; and sintering said powder-compressed member by applying pressure thereto from both sides thereof.

7. A method for manufacturing a cutter in accordance with claim 6, wherein said thin annular members are joined with each other with an adhesive.

8. A method for manufacturing a cutter in accordance with claim 6, wherein fine diamond abrasives are used as said abrasive grain.

9. A method for manufacturing a cutter in accordance with claim 6, wherein cubic boron nitride is used as said abrasive grain.

* * * * *

UNITED STATES PATENT AND TRADEMARK OFFICE

CERTIFICATE OF CORRECTION

PATENT NO. : 5,067,969

DATED : Nov. 26, 1991

INVENTOR(S) : Yusaku Matsuda

It is certified that error appears in the above-identified patent and that said Letters Patent is hereby corrected as shown below:

On the title page:

After line [22], insert the following:

--Foreign Application Priority Data

Mar. 10, 1989 [JP] Japan .....58877/89--

Signed and Sealed this

Second Day of November, 1993

*Attest:*

*Attesting Officer*

BRUCE LEHMAN

*Commissioner of Patents and Trademarks*